United States Patent [19]

Holzer, Jr.

[11] Patent Number: 5,016,501

[45] Date of Patent: May 21, 1991

[54] AUTOMATIC SHAFT LOCK

[75] Inventor: Michael Holzer, Jr., Chicago, Ill.

[73] Assignee: Skil Corporation, Chicago, Ill.

[21] Appl. No.: 226,366

[22] Filed: Jul. 29, 1988

[51] Int. Cl.[5] ..... B25B 17/00

[52] U.S. Cl. ..... 81/57.11; 173/12

[58] Field of Search ..... 173/12, 163, 5; 81/57.11, 57.31, 467

[56] References Cited

U.S. PATENT DOCUMENTS

| | | | |
|---|---|---|---|
| 3,802,518 | 4/1974 | Albert | 81/57.11 X |
| 3,866,493 | 2/1975 | Ringerud | 81/57.11 |
| 4,448,098 | 5/1984 | Totsu | 81/57.11 X |

*Primary Examiner*—Frank T. Yost

*Assistant Examiner*—Willmon Fridie, Jr.

*Attorney, Agent, or Firm*—Jones, Day, Reavis & Poque

[57] ABSTRACT

An automatic shaft lock for use in power tools with one end that carries implements such as screwdriver heads, drill bits and the like, permits use of the tool manually, i.e., without power. The locking mechanism allows rotation of the shaft by the motor but locks rotation of the shaft when torque is applied at the implement end or to the housing so as to allow manual use of the tool. In the preferred embodiment, a locking ring is concentric with an end of the spindle that is connected to the implement and also with an end of the output shaft driven by the motor. A wedging pin wedges against the locking ring to prohibit rotation of the spindle and the output shaft except when the spindle is driven by the output shaft which, when driven in either direction, traps the pin in a non-wedging position.

10 Claims, 2 Drawing Sheets

AUTOMATIC SHAFT LOCK

BACKGROUND OF THE INVENTION

The invention generally relates to locking mechanisms for power driven shafts More particularly, the invention relates to an automatic shaft lock for hand-held power tools.

Mechanisms of the general type under consideration were previously used as safety-lock couplings on conveyor drives and boat steering mechanisms and also as locks for power-driven tools. It is desirable to provide locking capability for hand-held power tools so that they can be used manually. For example, if a power tool lacks sufficient torque to tighten screws fully, it is advantageous to be able to use the same tool to tighten them manually Also, it is often desirable to set a screw manually in order to control the final torque applied to the screw. However, the typical tool has an implement-carrying unit connected in line with the motor and drive mechanism which, when torque is applied to the implement, results in slippage through the motor. Thus, it would be useful to lock the shaft of a hand-held power tool for manual operation.

In the past, some shaft locks have been incorporated into hand-held power tools to permit manual operation. Typically, the locks require the operator to activate a knob or button to lock the implement carrying unit for manual operation. Of interest are U.S. Pat. Nos. 4,448,098 and 3,802,518 which disclose mechanisms requiring the operator to set or actuate the locking mechanism. However, when the operator actuates the locking mechanism, power operation is restricted until the lock is de-activated.

Other tools feature an automatic locking device which locks the implement carrying unit against rotational movement relative to the tool housing unless the power is activated. One such device is the AEG Model EZ 502 made by Matsushita of Japan. This device uses a pair of small pawls, each resting in and pivoting about cavities formed in the housing, to engage teeth on the inside of a ring gear, thereby locking the carrying unit against rotational movement relative to the tool. When the motor is energized, a cam on the ring gear lifts a pawl out of engagement, allowing corresponding rotation of the implement end by the motor.

There are several disadvantages to the above device. First, the pawls are hard to manufacture because of their small size. Second, because the components are small, the device is difficult to assemble. Third, the engaging surfaces of the pawl are correspondingly small resulting in rapid wear and, potentially, a short lifetime. And fourth, use of a ratchet and pawl may produce an irritating clicking noise and undesirable friction resulting in reduction in power and unnecessary generation of heat.

U.S. Pat. No. 3,243,023 discloses a shaft locking mechanism without a pawl or ratchet that has been used on vehicle steering mechanisms to eliminate feedback of energy through the shaft. The '023 device utilizes a coupled output shaft and input shaft with multiple pairs of cylindrical rollers, each pair separated by a compression spring to maintain the rollers in locking positions respectively between a circular housing and a curved cam on the output shaft. When torque is applied to the input shaft, fingers located on the shaft contact the rollers compressing the springs and urging the rollers out of locking positions. Such a shaft locking mechanism also has been used for rudder-control and material handling equipment such as belt conveyors (See Tuttle, Stanley B., *Mechanisms For Engineering*, John Wiley & Sons, Inc. 1967).

The '023 device relies on a spring to force apart each pair of rollers in order to accomplish wedging. The torque applied to the input shaft must work against this spring force to unlock the device. Also, if the spring force should fail, due to repeated compression, for example, the locking action would fail. The device requires a pair of rollers separated by a spring to accomplish locking in both directions.

Therefore, it is an object of the invention to provide a locking drive shaft not requiring manual actuation of a locking mechanism by the operator, without the difficulty of manufacture and assembly of prior devices and with less possibility of mechanical failure.

It is another object of the invention to provide an automatic shaft lock for hand tools without restricting power operation and without the difficulty of manufacture and assembly of prior devices.

It is yet another object to provide an embodiment of an automatic locking device that does not produce a clicking sound or generate unnecessary friction during application of power.

These and other objects, features and advantages will become apparent from the following discussion of a preferred embodiment and an alternative embodiment of the invention.

SUMMARY OF THE INVENTION

In accordance with a preferred embodiment of the invention, a hand tool has an external housing which holds, in a straight or in-line orientation, a motor used to drive an output shaft, a locking ring fixed to the housing, a spindle shaft which has one end capable of carrying an implement such as a screwdriver head, and wedging means located in the annular space of the ring. The output shaft has one end with driving elements that protrude into the annular space of the locking ring and couple with and drive the spindle shaft. The coupled end of the spindle shaft has at least one flat portion in the plane of the annular space.

Locking is accomplished by the wedging means located in the annular space such that slight rotational movement of the spindle relative to the output shaft and locking ring causes the wedging means to be wedged between the flat portion of the spindle and the locking ring. Thus, when torque is applied to the implement carrying end of the spindle during manual operation, the spindle is locked against rotational movement relative to the rest of the tool. However, when power is applied to the motor, causing the motor to drive the output shaft, the driving elements prohibit the wedging means from wedging against the locking ring and trap them in a position relative to the flat portion of the spindle so that the spindle is not locked but travels with the rotation of the motor.

DETAILED DESCRIPTION OF THE INVENTION

Figure 1:
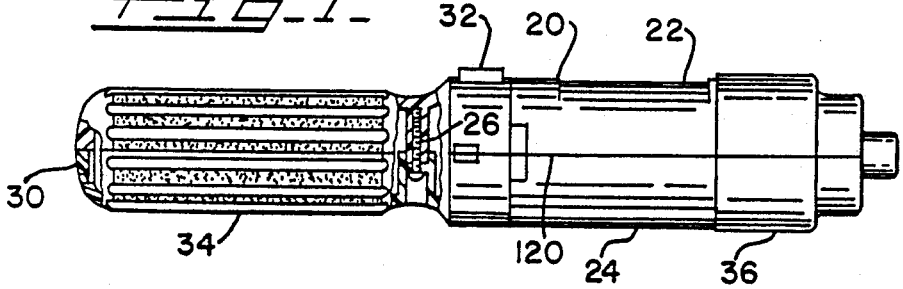
FIG. 1 is a side elevation view of the tool with portions cut away to reveal certain interior details.

The present invention may be better understood by detailed reference to the figures of the preferred embodiment. Referring first to FIG. 1, the tool is generally designated as 20. The tool is externally comprised of upper housing half 22 and lower housing half 24. The housing halves 22, 24 are held together by a screw 26 (shown in a broken-away portion of FIG. 1) which slides through passageway 28 to snugly grasp the lower housing half 24 to the upper housing half 22, and by a latch 30 (shown in a broken away portion of FIG. 1) formed on the upper housing half 22 which snaps into a slot (not shown) formed in the lower housing half 24 to hold the two halves firmly together.

Figure 2:
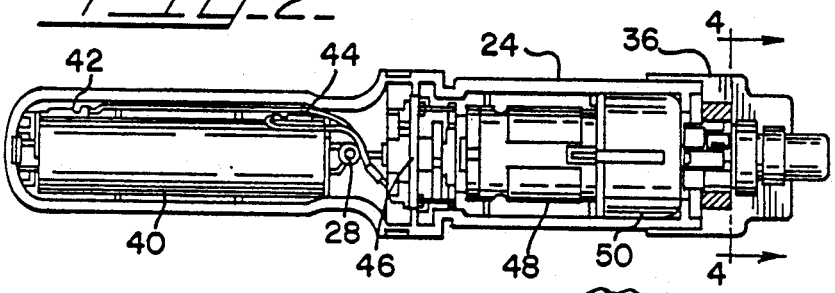
FIG. 2 is a bottom cross-sectional view of a tool made according to the preferred embodiment of the invention.
Figure 2A:
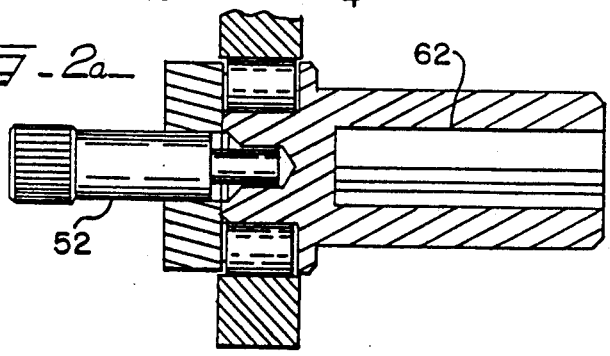
FIG. 2*a* is an enlarged cross-sectional view of the shaft locking mechanism of FIG. 2 excluding the remainder of the tool.

The housing contains openings at various points to provide access to the workings of the device. A switch 32 is a rocking button that protrudes from a space in the housing. The switch 32 activates the motor in one direction when it is depressed to one side and in the opposite direction when depressed to the opposite side. The device is de-energized when neither side of the switch 32 is depressed and the switch 32 is thus in a central position. Recharging access ports (not shown) allow access to recharging contacts without opening up the housing or removing the battery or battery Portion of the tool. An opening in the tool head or front of the tool housing 36 allows a spindle shaft 60, which has a cavity 62 (best seen in FIG. 2*a*) to hold driving tools, screwdriver bits or drill bits, mixing implements or any other appropriate tool known in the art.

A rechargeable battery 40 is contained in the housing, inside the battery portion or handle 34 of the device. The battery has positive and negative terminals 42 and 44 which are connected to a reversing switch 46, used to change the rotational direction of the electric motor 48. The motor 48 drives a gearing system 50 which in turn drives the output shaft 52, which drives the spindle shaft 60 which is coupled to the output shaft 52 as better seen in FIG. 2*a*. Tools placed in the cavity 62 are rotated as the spindle 60 rotates. Reversal of the direction of spin of the motor 48 by the reversing switch 46 will reverse the direction of spin of the gearing system 50, output shaft 52, spindle 60, and driving tool.

The shaft lock of the present invention comprises a plurality of driving elements 54 that are connected to and rotate in the output shaft 52. Each driving element 54 has a driving surface 110 that is adapted to contact a driving surface 112 of the spindle 60. The driving elements 54 also have interior surfaces 114 and outer surfaces 116. The spindle 60 also includes surfaces 118 that comprise portions of cylinders centered on a line 120 that passes through the axis 122 of the shaft lock. In the preferred embodiment, the surfaces 118 are planar, representing arcs of infinite radii.

Figure 4:
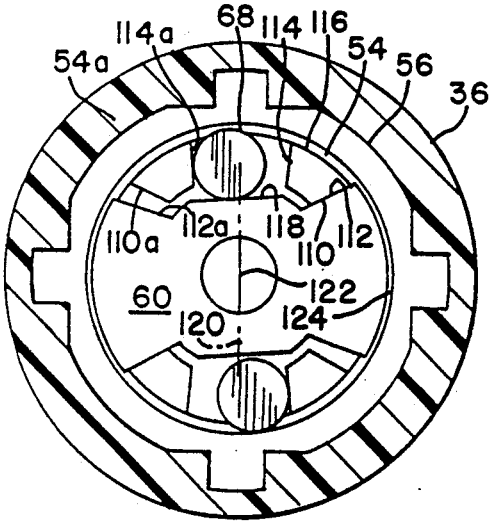
FIG. 4 is a cross-sectional view of the shaft locking mechanism taken along line 4—4 of FIG. 2 shown in an unlocked position.

The substantially cylindrical inside surface 124 of the locking ring 56 is preferably sized to clear the outer surfaces 116 of the driving elements 54 and the spindle 60. One surface 118 of the spindle shaft 60, an adjacent and facing pair of the interior surfaces 114 and 114*a*, and the inside surface 124 enclose a pin 68 in a way that is best seen by referring to FIGS. 4 and 5. FIG. 4 shows the shaft lock in an unlocked condition. The driving element 54 of FIG. 4 is driving the spindle 60 in a clockwise direction. The driving surface 112 is flush against the driving surface 110 to exert a driving force. This has rotated the driving element 54 with respect to the spindle 60 so that there is clearance between the driving surfaces 110*a* and 112*a*. The pin 68 is moved by the interior surface 114*a* in a region where the pin 68 cannot contact both the surface 118 and the inside surface 124.

An attempt to rotate the driving element 54 in a counterclockwise direction would close the gap between the surfaces 110*a* and 112*a*, would open a corresponding gap between the surfaces 110 and 112, and would leave the pin 68 against the surface 114. The pin 68 would again be free to move, and the shaft lock would thus be unlocked, permitting motion in the counterclockwise direction.

Figure 5:
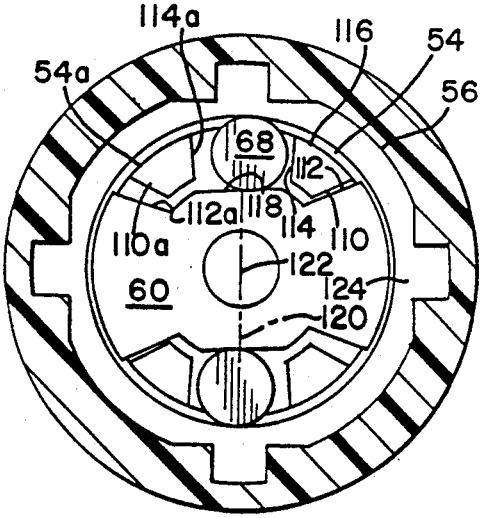
FIG. 5 is a cross-sectional view similar to that of FIG. 4 showing the wedging pins shown in a locked position.
Figure 3:
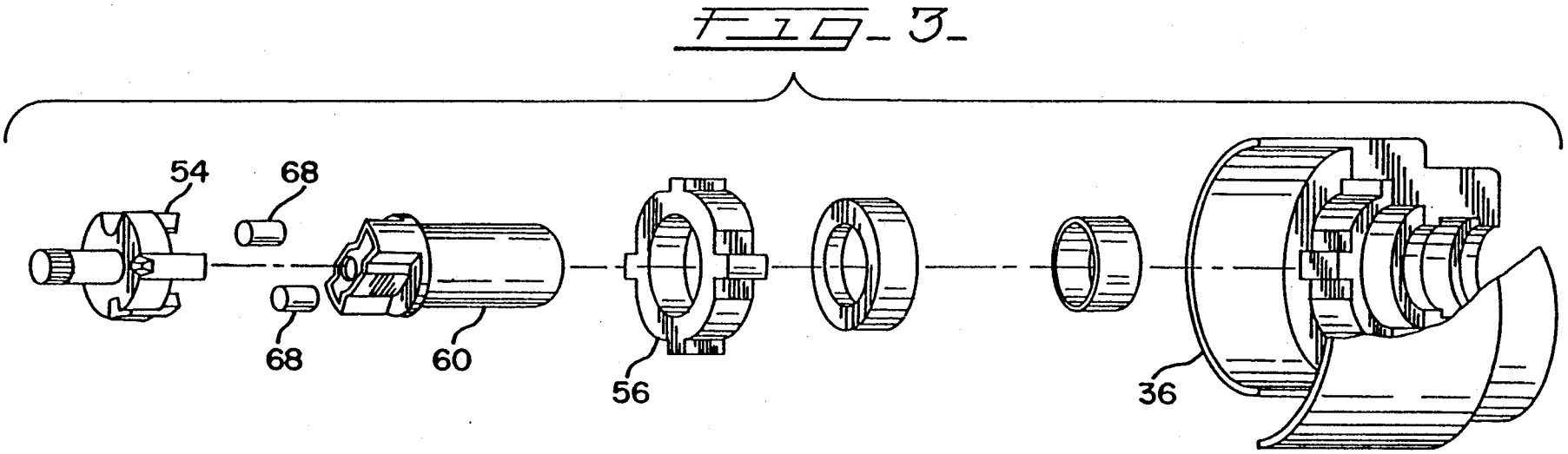
FIG. 3 is an exploded view of the preferred embodiment of the shaft locking mechanism, shown with tool head partially cut-away.

FIG. 5 is a view of the shaft lock in a locked configuration. This is produced by applying torque either to the spindle 60 or to the locking ring 56 of FIG. 5. The locking ring 56 is connected to the tool 20, so applying torque to the tool 20 applies it to the locking ring 56. The effect of applying torque to the spindle shaft 60 or the locking ring 56 has caused the pin 68 to be rolled to the right in FIG. 5 in comparison to its position in FIG. 4. In FIG. 5, the pin 68 is wedged between the surface 118 of the spindle 60 and the inside surface 124 of the locking ring 56. The spindle shaft 60 is thus prevented from moving with respect to the tool 20. Application of torque to the housing then applies torque to the cavity 62 and therefore to any tool mounted in the cavity 62.

When the tool is used to drive a screw without activating the motor 48, the tool housing 36, and the locking ring 56 are turned in a clockwise direction against the spindle shaft 60, which turns the screw. This action causes the pins 68 to rotate and become wedged between the spindle shaft 60 and the locking ring 56, as shown in FIG. 5. It should be noted that the driving elements 54 of the output shaft 52 are passive during this locking action. The locking action would occur even if the elements 54 were not there. Manual use of the tool to remove a screw requires rotation of the tool housing 36 and the spindle shaft 60 in a counterclockwise direction against the torque of the screw. The locking action described above again restricts relative movement of the tool housing 36 and locking ring 56 with respect to the spindle shaft 60. Therefore, manual movement of the housing in either direction locks the spindle shaft 60 from rotational movement relative to the tool housing 36.

Although the present invention may be used with any hand-held portable power tool and any implement, it is particularly useful with a battery-powered electric screwdriver. It is often difficult with an electric screwdriver to control applied torque to set a screw properly. Without using a shaft lock such as that of the present invention, the screwdriver blade is free to turn with respect to the housing, and it is difficult or impossible to set a screw. Use of the shaft lock of the present invention enables an operator to drive a screw as far as desired by power, and then to use the tool as a manual screwdriver to set the screw. This increases the utility of the battery-powered electric screwdriver. Similar advantages are obvious when the implement used with the portable tool is a drill, wood bit, countersink, or the like.

From the above description, it will be apparent that there is thus provided an automatic shaft locking mechanism with the advantages discussed, but which is clearly subject to variation and modification without departing from the invention contemplated herein. The scope of the invention, therefore is not to be limited to the specific embodiments disclosed above, but is to be judged by the legitimate and valid breadth of the claims appended hereto.

What is claimed is:

1. An automatic shaft lock for a power tool having a housing and a motor disposed within the housing to rotate an implement, the automatic shaft lock preventing rotation of the implement with respect to the housing when torque is applied to the implement or to the housing, the automatic shaft lock comprising:

a locking ring fixed to the housing and defining an annular space;

a spindle shaft at least partially contained in the housing and rotatably supported in the housing, the spindle shaft having an end projecting into the annular space of the locking ring, the spindle end having at least one flat side partially bisecting the annular space;

a single wedging pin located between each flat side of the spindle end and the locking ring such that slight rotational movement of one of the spindle end and the locking ring causes the wedging pin to be wedged between the flat side and the locking ring;

an output shaft at least partially contained in the housing and rotatably supported in the housing, the output shaft having at least one pair of elements projecting into the annular space, the output shaft being slightly rotatably movable relative to the spindle end such that when the output shaft is driven in either direction one element of the pair drives the spindle end at one of the flat sides while the other element of each pair traps the wedging pin in a position in which it will not wedge between the flat side of the spindle end and the locking ring.

2. The drive shaft of claim 1 wherein the end of the spindle shaft has two flat sides partially bisecting the annular space and two wedging pins, one pin disposed between each flat side and the locking ring.

3. The drive shaft of claim 2 wherein the wedging pins are cylindrical.

4. The drive shaft of claim 1 wherein the output shaft has two pairs of drive elements projecting into the annular space such that when the output shaft is driven in either direction, one element of each pair contacts a flared portion of the spindle shaft to drive the spindle, while the other element of each pair traps the wedging pin in a position in which it will not wedge between the spindle and the locking ring.

5. A shaft lock in a housing which has one end that is prohibited from rotational movement relative to a housing unless the shaft is driven from its other end, the shaft lock comprising:

a locking ring fixed to the housing and defining an annular space;

a spindle shaft at least partially contained in the housing and rotatably supported in the housing, the spindle shaft having an end projecting into the annular space of the locking ring, the end having two flat sides partially bisecting the annular space;

two cylindrical wedging pins located in the annular space on the two flat sides of the spindle; and an output shaft at least partially contained in the housing and rotatably supported in the housing, the output shaft being slightly rotatable movable relative to the end of the spindle and having two pairs of driving elements projecting into the annular space such that when the output shaft is driven in either direction, one element of each pair contacts the spindle to drive it while the other element of each pair traps the pin in a non-wedging position, and such that when the torque is applied to the spindle shaft, the wedging pins are urged into a wedging position between the flat sides of the spindle shaft and the locking ring.

6. A hand tool capable of either manual or power drive, the hand tool having an axis, the hand tool comprising:

a housing;

a motor contained in the housing;

a locking ring fixedly supported in the housing to define an annular space;

an output shaft in the housing, the output shaft capable of being driven at its first end by the motor and having a second end with a pair of elements located thereon, the second end protruding into the annular space;

a spindle shaft having one end capable of carrying an implement and a second end projecting into the annular space, the second end having at least one flat portion in the plane of the annular space and parallel to the axis of the hand tool; and a wedging pin located in the annular space between the flat portion and the locking ring such that slight rotational movement causes the wedging pin to be wedged between the spindle shaft and the ring, the output shaft elements straddling the wedging pin such that torque of the output shaft to drive the spindle at its second end causes one element to contact the spindle and the other to trap the wedging pin in a non-wedging position.

7. The hand tool of claim 6 wherein the motor is a reversible electric motor.

8. The hand tool of claim 6 wherein the implement carried by the spindle shaft is a screwdriver head.

9. The hand tool of claim 6 wherein the second end of the spindle shaft has two flat sides and wherein the second end of the output shaft is slightly rotatably movable relative to the second end of the spindle shaft and has at least two pair of elements protruding into the annular space and wherein a single flat side and a single wedging pin are associated with each pair such that when the first end of the output shaft is driven in either direction one element of each pair contacts the spindle while the other element traps the wedging pin in a position in which it will not wedge between the ring and the flat portion of the spindle.

10. The hand tool of claim 6 wherein the wedging pin is substantially cylindrical.

* * * * *

US005016501B1

REEXAMINATION CERTIFICATE (3265th)

United States Patent [19] [11] B1 5,016,501

Holzer, Jr. [45] Certificate Issued Jul. 15, 1997

[54] AUTOMATIC SHAFT LOCK

[75] Inventor: Michael Holzer, Jr., Chicago, Ill.

[73] Assignee: S-B Power Tool Company, Chicago, Ill.

Reexamination Request:
No. 90/003,651, Dec. 1, 1994

Reexamination Certificate for:

| | |
|---|---|
| Patent No.: | **5,016,501** |
| Issued: | **May 21, 1991** |
| Appl. No.: | **226,366** |
| Filed: | **Jul. 29, 1988** |

[51] Int. Cl.[6] ..... B25B 17/00
[52] U.S. Cl. ..... 81/57.11
[58] Field of Search ..... 173/178, 5; 81/57.11; 192/8 R; 475/2

[56] References Cited

U.S. PATENT DOCUMENTS 3,243,023 3/1966 Boyden ..... 192/8 R
3,308,684 3/1967 Wilkinson et al. ..... 475/2
3,329,185 7/1967 Hettich et al. .

FOREIGN PATENT DOCUMENTS 1058593 5/1963 United Kingdom .
1179105 5/1966 United Kingdom .

*Primary Examiner*—Willmon Fridie, Jr.

[57] ABSTRACT

An automatic shaft lock for use in power tools with one end that carries implements such as a screwdriver heads, drill bits and the like, permits use of the tool manually, i.e., without power. The locking mechanism allows rotation of the shaft by the motor but locks rotation of the shaft when torque is applied at the implement end or to the housing so as to allow manual use of the tool. In the preferred embodiment, a locking ring is concentric with an end of the spindle that is connected to the implement and also with an end of the output shaft driven by the motor. A wedging pin wedges against the locking ring to prohibit rotation of the spindle and the output shaft except when the spindle is driven by the output shaft which, when driven in either direction, traps the pin in a non-wedging position.

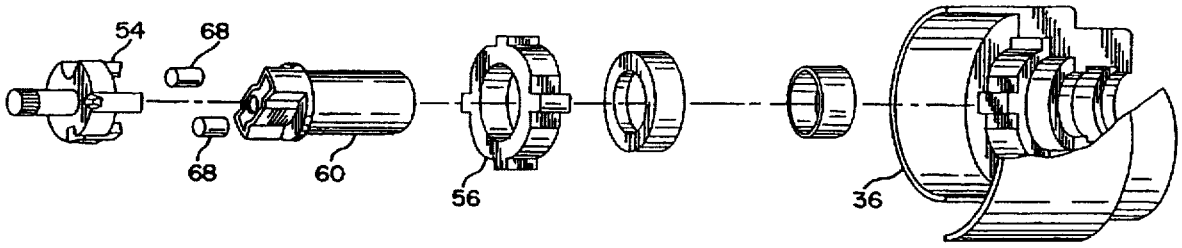

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–10 are cancelled.

* * * * *